United States Patent [19]

Akbar

[11] 4,247,387

[45] Jan. 27, 1981

[54] PROCESS FOR THE CONTINUOUS THERMAL CRACKING OF HYDROCARBON OILS

[75] Inventor: Mohammed Akbar, The Hague, Netherlands

[73] Assignee: Shell Oil Company, Houston, Tex.

[21] Appl. No.: 55,440

[22] Filed: Jul. 6, 1979

[30] Foreign Application Priority Data

Jul. 11, 1978 [GB] United Kingdom ..... 29432/78

[51] Int. Cl.[3] ..... C10G 9/14

[52] U.S. Cl. ..... 208/106; 196/111; 208/131

[58] Field of Search ..... 208/132, 131, 106, 153, 208/157; 196/111

[56] References Cited

U.S. PATENT DOCUMENTS

| | | | |
|---|---|---|---|
| 1,681,321 | 8/1928 | Brandt | 208/131 |
| 1,776,023 | 9/1930 | Hadaway | 208/106 |
| 2,164,132 | 6/1939 | Doherty | 208/106 |
| 2,433,798 | 12/1947 | Voorhees | 208/153 |

OTHER PUBLICATIONS

Washimi et al., Pachec 1977, pp. 534–541 (1977).

*Primary Examiner*—Herbert Levine
*Attorney, Agent, or Firm*—Ronald R. Reper

[57] ABSTRACT

A continuous process for thermal cracking of heavy hydrocarbon oil feed to residual products having improved stability comprises passing the feed under specified conditions through a thermal conversion zone having at least two mixing stages.

9 Claims, 1 Drawing Figure

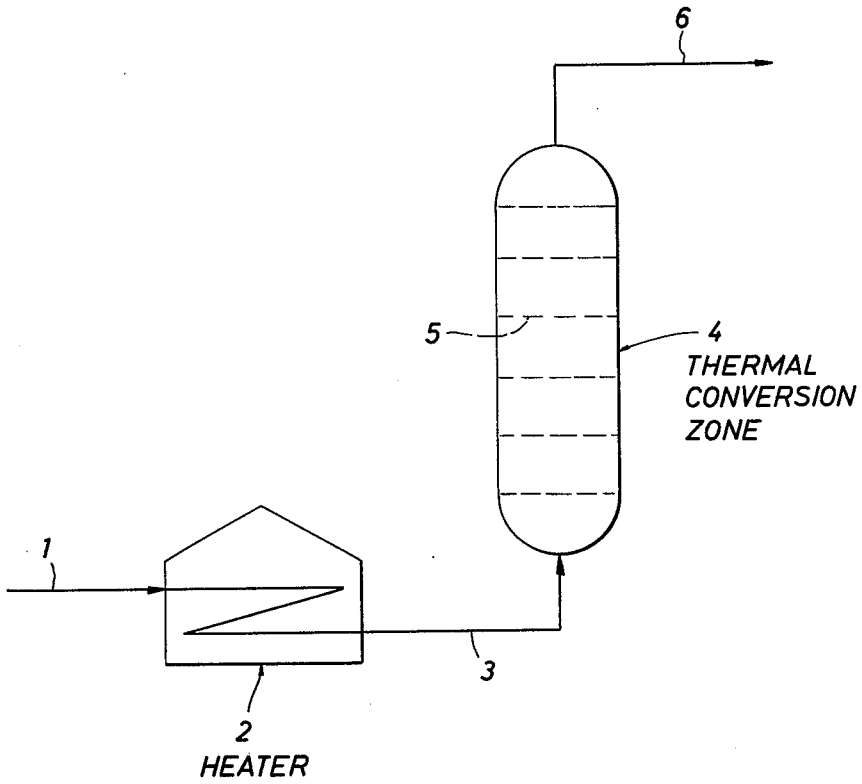
6
5
4
THERMAL
CONVERSION
ZONE
1
3
2
HEATER

PROCESS FOR THE CONTINUOUS THERMAL CRACKING OF HYDROCARBON OILS

BACKGROUND OF THE INVENTION

The present invention relates to a process for the continuous thermal cracking of hydrocarbon oils.

For the thermal cracking of residual feedstocks—both long and short residues—two types of processes, namely furnace cracking and soaker cracking, are available. Furnace cracking implies that the actual cracking takes place in the last pipes of the furnace and to some extent in a transfer line which leads from the furnace outlet to a subsequent process stage. Residence times are not exactly known or controlled, but are short being of the order of one minute in the cracking zone. The pressure in the cracking zone varies to a great extent; it is high at the furnace inlet and quite low at the furnace outlet. In the case of soaker cracking, the feed is heated up to a suitable temperature and allowed to stay at that temperature for a period of usually 10–30 minutes in a vessel known as a soaker. A soaker is, hence, nothing more than a large empty unheated vessel which allows cracking to take place over a prolonged period. No heat is provided to the soaker and, since the cracking reaction is endothermic, the temperature of the oil drops by 10°–30° C. during the passage through the soaker.

Soaker cracking has basically the advantage of a significantly lower fuel requirement (hence, entailing the use of a smaller furnace) than is the case with furnace cracking. For this reason, a soaker is considered an attractive means of debottlenecking when furnace capacity is a limiting factor. U.S. Pat. No. 1,899,889 mentions a method for the thermal cracking of petroleum oils which comprises heating the oil in a series of tubes to a high temperature, introducing the hot feed into a digesting zone or soaking drum in which most of the cracking takes place and hence conducting the liquid and vapors into a fractionating zone, such as a bubble tower.

According to the above U.S. patent specification the hot feed is introduced into the lower portion of the soaking drum and the liquid and vaporous products leave through a common line at the upper portion of the drum.

In the process according to this U.S. patent specification an empty soaking vessel has been used.

We have found that at the same conversion of feed to gas plus gasoline the net amount of gas oil produced in soaker operation is somewhat higher than that obtained in furnace cracking.

However, the stability of the cracked residue is somewhat lower for soaker cracking than for furnace cracking at the same conversion levels.

It has now been found that the problem of the poorer stability of the cracked residue in case of soaker cracking can be solved.

According to the present invention a maximum conversion with a stable fuel as the heaviest of the products, is obtained by soaking the feed during an average residence time not shorter than 5 min. and not longer than 60 min. in a conversion zone which comprises at least two mixing stages. For a theoretical background of mixing stages see Perry, Chemical Engineers' Handbook, 3rd Edition, 1950, Section 17, page 1230.

SUMMARY OF THE INVENTION

The invention provides a process for the continuous thermal cracking of hydrocarbon oils which comprises heating the hydrocarbon oil feed, and passing the hot feed upwardly through a thermal conversion zone, in which conversion zone the feed has an average residence time not shorter than 5 min. and not longer than 60 min. and which conversion zone comprises at least 2 mixing stages.

BRIEF DESCRIPTION OF THE DRAWING

The Drawing is a diagrammatic representation of an apparatus suitable for carrying out the process of the invention.

DESCRIPTION OF PREFERRED EMBODIMENTS

Preferably the average residence time in the conversion zone is not shorter than 10 min. and not longer than 40 min. and the conversion zone is comprised of at least 5 mixing stages. Although in theory the number of mixing stages is not limited, in practice there will be a limit depending on constructional and process-technical restrictions.

This practical limit will be in most cases about 15 stages.

Besides the residence time, the temperature is an important process variable in thermal cracking. The desirable effect of thermal cracking, i.e. the decrease of molecular weight and viscosity of the feed, arise from the fact that the larger molecules have a higher cracking rate than the smaller molecules. It is known from Sachanen, Conversation of Petroleum, 1948, Chapter 3, that at lower temperatures the difference in cracking rates between larger and smaller molecules increases and, hence, the resultant desirable effect will be greater. At very low temperatures the cracking rate decreases to uneconomically small values. To achieve the best results the temperature in the conversion zone is preferably in the range of from 400° to 500° C.

Another important variable is the pressure in the reaction zone. Pressure has a direct effect on evaporization, which may indirectly influence the temperature. At high pressure a relative little amount of the feed will evaporate which costs little heat of evaporization. Therefore, the temperature will decrease just a little. At low pressure a relative big amount of the feed evaporates causing the stronger decrease in temperature.

The residence time of the oil to be cracked is also influenced by the pressure.

High pressure will cause only a small vapor flow to be produced which leads to a lower vapor hold-up in the reaction zone. Therefore, the residence time of liquid feed will be relatively long. Low pressures have on the contrary a decreasing effect on the residence time of the liquid feed.

While the pressure in the reaction zone of a furnace cracker may vary a great deal, a selected constant pressure can be applied in the case of soaker cracking.

This pressure is preferably chosen in the range of from 2 to 30 bar.

In accordance with the invention the staging effect in the soaker is preferably achieved by installing internals therein.

Therefore, the invention particularly relates to a process for the continuous thermal cracking of hydrocarbon oils, which comprises preheating the hydrocarbon oil feed and causing the hot feed to flow upwards through a thermal conversion zone, for which process a soaking vessel is used as conversion zone and in which vessel internals have been installed.

Preferably, the internals are horizontal perforated plates, which effectively increase the number of mixing stages, whereas the number of plates is preferably in the range of from 1 to 20.

Because of the typical form and size of gas bubbles, which must go through the perforations, the perforated plates contain preferably round holes with a diameter in the range of from 5 to 200 mm.

The perforated plates may contain slits having a width in the range of from 5 to 200 mm.

The percentage of the plate surface which has been occupied by free area is limited. If this percentage is too high, the strength of the plate will not be sufficient and moreover the staging effect will be poor. On the other hand, if the free area percentage is too low the flow resistance will be high which is disadvantageous for the efficiency of the process.

To achieve optimal results with the perforated plates, preferably 1–30% of the plate area has been occupied by free area.

Because of the fact that during the cracking process the amount of vapor products increases it is advantageous to carry out the upflow process in a vessel in which the percentage of free area per plate increases from the bottom upward. Preferably, the ratio free area of the top plate to the free area of bottom plate is in the range of from 2 to 6.

Preferably, the perforated plates have been installed horizontally at a mutual distance which is in the range of from 10 to 200 cm. The mutual distance should not be too short in order to avoid coking and to allow inspection. On the other hand, the mutual distance should not be more than 200 cm, because the efficiency of the process would then be decreased.

It is also suitable to use internals which are vertical sections, e.g., tubes. These vertical sections preferably have a hydraulic diameter in the range from 5—100 cm. The term "hydraulic diameter" is two times the hydraulic radium ($R_H$) as described in Perry, Chemical Engineers' Handbook, 3rd edition, McGraw-Hill Book Company, Inc. 1950, page 378. Using such internals, plugging by coke will not easily occur. For reasons of common availability it is preferred to use pipes or rectangular sections. Horizontal grids which are placed above each other may also be used as internals.

Process in which the soaker contains internals which comprise both horizontal and vertical elements are also used with advantage. To achieve an optimal staging effect with the available internals, the vessel in which the cracking process is carried out is preferably cylindrical with a L/D ratio which is in the range of from 2 to 15.

The present process will now be further elucidated with reference to the FIGURE. A residual oil feedstock is passed through a line 1 to a furnace 2 where it is heated to a temperature in the range from 400°–500° C.

The hot feed is passed through a line 3 to a soaker 4 in which it flows upward through 6 horizontal perforated plates 5. The cracking product leaves the soaker at the top via a line 6 through which it is transferred to a separating unit (not shown) to be separated into a gas, a gasoline, a heating oil and fuel oil.

The following example shows an embodiment of the present invention to which the invention is by no means restricted.

EXAMPLE

A thermal cracking process was carried out according to the present invention as illustrated by the FIGURE. Table I gives the feedstock specifications, operating conditions and product yields and properties.

Table I

| | |
|---|---|
| Feedstock specifications: | |
| Specific gravity 15/4 | 0.970 |
| Viscosity | 350 cS at 50° C. |
| Sulphur, % wt | 3.9 |
| Asphaltenes, % wt | 2.4 |
| Operating conditions: | |
| Inlet soaker temperature, °C. | 458 |
| Outlet soaker temperature, °C. | 435 |
| Pressure, bar abs. | 10 |
| Average residence time, min. | 20 |
| Number of mixing stages | 5 |
| Number of horizontal plates | 6 |
| Perforation type | round holes with diameter of 40 mm |
| Percentage of free area per plate, % | 10 |
| L/D ratio of soaking vessel | 6 |
| Product yields (% wt on feed): | |
| Gas | 2.1 |
| Gasoline (boiling range $C_5$-165° C.) | 4.5 |
| Gas oil | 16.4 |
| Fuel oil | 77.0 |
| Product properties: | |
| Fuel viscosities, cS at 50° C. | 350 |
| Stability of cracked residue[A] rating | 1 |

[A]The stability has been determined with the ASTM Test Procedure D 1661 (ASTM standards, Parts 17 and 18, Petroleum Products, American Society for Testing and Materials, 1964).

COMPARATIVE EXPERIMENT

In order to demonstrate the technical advantage of the process according to the invention the same feedstock as in the Example was subjected to a thermal treatment under the same conditions as mentioned in the Example. However, in this process a soaking vessel without internals was used. The results are given below in Table II.

Table II

| | |
|---|---|
| Product yields (% wt on feed): | |
| Gas | 2.1 |
| Gasoline (boiling range $C_5$-165° C. | 4.5 |
| Gas oil | 16.4 |
| Fuel oil | 77.0 |
| Product properties: | |
| Fuel viscosity, cS at 50° C. | 350 |
| Stability of cracked residue[A] rating | 2 |

[A]The stability has been determined with the ASTM Test Procedure D 1661 (ASTM standards, Parts 17 and 18, Petroleum Products, American Society for Testing and Materials, 1964).

What is claimed is:

1. A process for the continuous thermal cracking of residual hydrocarbon oils, which comprises heating the residual hydrocarbon oil feed and passing the total hot feed at a temperature in the range from 400° to 500° C. upwardly through an upright thermal conversion zone having at least 2 mixing stages, said zone comprising an unheated soaking vessel containing at least one of: (a) from 1 to 20 horizontal perforated plates, and (b) vertical sections with a hydraulic diameter in the range from 5 to 100 mm in which conversion zone the feed has an average residence time of between 5 to 60 minutes, and withdrawing cracked product from said conversion zone.

2. A process as in claim 1, wherein the said average residence time in the conversion zone is between 10 and 40 minutes and wherein the said conversion zone comprises at least 5 mixing stages.

3. A process as in claim 1, wherein the pressure in the conversion zone is in the range of from 2 to 30 bar gauge.

4. A process as in claim 1, wherein the perforated plates contain round holes with a diameter in the range of from 5 to 200 mm.

5. A process as in claim 1, wherein 1–30% of the total plate area is free area.

6. A process as in claim 1, wherein the conversion zone contains at least two plates and the percentage of free area per plate increases from the bottom plate upwardly to the top plate.

7. A process as in claim 6, wherein the ratio of free area of top plate to the free area of bottom plate is in the range of from 2 to 6.

8. A process as in claim 1, wherein the perforated plates are installed horizontally at a mutual distance in the range of from 10 to 200 cm.

9. A process as in claim 1, wherein the vessel is cylindrical with a L/D ratio which is in the range of from 2 to 15.

* * * * *